United States Patent [19]

Murayoshi

[11] Patent Number: 4,674,737

[45] Date of Patent: Jun. 23, 1987

[54] AUTOMATIC SHEET FEEDING DEVICE

[75] Inventor: Seiji Murayoshi, Machida, Japan

[73] Assignee: Ricoh Company, Ltd., Tokyo, Japan

[21] Appl. No.: 666,982

[22] Filed: Oct. 31, 1984

[30] Foreign Application Priority Data

| | | | |
|---|---|---|---|
| Oct. 31, 1983 | [JP] | Japan | 58-204165 |
| Oct. 31, 1983 | [JP] | Japan | 58-204166 |
| Oct. 31, 1983 | [JP] | Japan | 58-204167 |
| Oct. 31, 1983 | [JP] | Japan | 58-168496[U] |
| Oct. 31, 1983 | [JP] | Japan | 58-168492[U] |
| Dec. 29, 1983 | [JP] | Japan | 58-202891[U] |

[51] Int. Cl.[4] ..... B65H 3/52

[52] U.S. Cl. ..... 271/124

[58] Field of Search ..... 271/121, 124, 122

[56] References Cited

U.S. PATENT DOCUMENTS

| | | | |
|---|---|---|---|
| 1,506,423 | 8/1924 | Gray | 271/121 |

FOREIGN PATENT DOCUMENTS

| | | | |
|---|---|---|---|
| 2332034 | 9/1975 | Fed. Rep. of Germany . | |
| 3048036 | 9/1981 | Fed. Rep. of Germany . | |
| 13034 | 1/1982 | Japan | 271/124 |
| 13033 | 1/1982 | Japan | 271/124 |
| 52127 | 3/1983 | Japan | 271/124 |
| 113048 | 7/1983 | Japan | 271/124 |

*Primary Examiner*—Richard A. Schacher

*Attorney, Agent, or Firm*—Oblon, Fisher, Spivak, McClelland & Maier

[57] ABSTRACT

An automatic sheet feeding device for feeding sheets automatically one after another to an operation station including a sheet tray for supporting a stack of sheets thereon, a separation roller being contact with a lowermost sheet of the stack of sheets, a separation member including a free end portion maintained in contact with the separation roller. At least one sheet pressing member is located in such manner that its free end portion forces the sheets against the separation roller in a position which is located upstream of the separation member is in contact with the separation roller.

4 Claims, 16 Drawing Figures

AUTOMATIC SHEET FEEDING DEVICE

BACKGROUND OF THE INVENTION

This invention relates to automatic sheet feeding devices suitable for use with facsimile systems, electrophotographic copying apparatus, printing presses, packing machines, etc., in which sheets which may include documents, recording sheets, printing sheets, packing sheets, etc., are fed automatically one after another to an operation station which may be a document read-out station, a printing station or a packing station, and more particularly it is concerned with a sheet feeding device for automatically feeding a plurality of sheets placed on a sheet tray in a stack by separating them into individual sheets.

In one type of automatic sheet feeding device known in the art, a portion of an outer peripheral surface of a separation roller protrudes from a sheet supporting surface of a sheet tray, and a separation member is brought into contact with the protruding portion of the outer periphery of the separation roller so as to form a wedge-shaped space defined between the separation roller and the separation member. In this type of automatic sheet feeding device, a stack of sheets are placed on the sheet tray in such a manner that a leading end portion of a lowermost sheet of the stack of sheets is brought into contact with the protruding portion of the outer periphery of the separation roller. Simultaneously as or immediately after the stack of sheets is placed on the sheet tray, the separation roller is rotated in a sheet feeding direction to allow a plurality of sheets to enter the wedge-shaped space from the stack of sheets. As a result, the lowermost one of the plurality of sheets entering the wedge-shaped space continues its forward movement by virtue of a sheet feeding force produced by friction acting between the lowermost sheet and the separation roller while the sheets overlying the lowermost sheet are prevented from continuing their forward movements by friction acting between one of the sheets and the separation roller and friction acting between the sheets themselves. Thus, the lowermost sheet of the plurality of sheets entering the wedge-shaped space is automatically separated from the overlying sheets, so that only one sheet is fed at a time to a position disposed downstream of the separation roller and the separation member.

The sheets placed on the sheet tray may include sheets of different natures and different conditions. Some sheets may tend to curl toward the separation member, and in some sheets, friction acting between them may be higher than in other sheets. When the stack of sheets placed on the sheet tray tends to curl up, the area of contact between each sheet and the separation roller would be lessened and a predetermined sheet feeding force could not be produced by the friction between the sheet and the separation roller, with a result that a failure to feed a sheet might occur. When the friction acting between the sheets is high, other sheets would follow the sheet moved forwardly in a sheet feeding direction by the separation roller, causing a redundant sheet feeding to occur.

The separation member in contact with a surface of the protruding portion of the outer periphery of the separation roller and cooperating therewith to define therebetween the wedge-shaped space as described hereinabove is moved slightly away from the separation roller by a plurality of sheets entering the wedge-shaped space. As the number of sheets fed to the operation station increases, the number of sheets entering the wedge-shaped space also increases. In this case, the separation member might be moved away from the separation roller a distance greater than is necessary, so that it would become impossible to force the plurality of sheets, particularly the lowermost sheet, against the separation roller with a predetermined force, making it impossible to feed one sheet after another to the operation station.

To obviate the aforesaid problem of redundant sheet feeding and no sheet feeding, proposals have hitherto been made to provide an auxiliary feed roller in a position upstream of the separation roller with respect to the sheet feeding direction to aid in moving the sheets in the predetermined direction, or to increase the diameter of the separation roller to increase the area of the peripheral surface of the separation roller, to enable a sufficiently high sheet feeding force to move the lower sheet in the sheet feeding direction to be produced by friction.

These proposals have, however, had the disadvantage that the construction of the mechanism becomes complex or the apparatus becomes too large in size.

SUMMARY OF THE INVENTION

This invention has been developed for the purpose of obviating the aforesaid problems of the prior art. Accordingly, the invention has as its object the provision of an automatic sheet feeding device enabling one sheet after another to be positively fed by a mechanism of simple construction.

To accomplish the aforesaid object, the invention provides an automatic sheet feeding device comprising a sheet tray for supporting a stack of sheets thereon, a separation roller having a portion of an outer periphery thereof protruding from a sheet support surface of a forward end portion of the sheet tray on which the stack of sheets is supported, said separation roller rotating in a sheet feeding direction, and a separation member including a base which is secured in place and a free end portion maintained in surface-to-surface contact with a surface of the protruding portion of the outer periphery of the separation roller, said separation member cooperating with said separation roller to define therebetween a wedge-shaped space, wherein the improvement comprises at least one sheet pressing member cooperating with said separation roller to define therebetween an auxiliary wedge-shaped space and operative to force a plurality of sheets against the outer periphery of the separation roller in a position which is located upstream of a position in which said free end portion of the separation member is in surface-to-surface contact with the separation roller.

By virtue of the provision of the sheet pressing member, leading ends of a plurality of sheets moving along the surface of the protruding portion of the outer periphery of the separation roller cause the sheet pressing member to flex in a direction in which it moves away from the separation roller and then enter the wedge-shaped space defined between the separation member and the separation roller, before stopping in a position in which they abut against the separation member. At this time, the leading end portions of the plurality of sheets are forced against the surface of the protruding portion of the outer periphery of the separation roller by the resilience of the sheet pressing member flexed as described hereinabove. Thus, as the separation roller rotates to feed the lowermost sheet of the plurality of sheets in the sheet feeding direction, friction of sufficiently high magnitude is produced between the lowermost sheet and the separation roller to positively feed the lowermost sheet in the sheet feeding direction.

Even if the leading end portions of the plurality of sheets brought into contact with the separation roller were curling upwardly, the curling leading end portions are flattened toward the separation roller by the sheet pressing member, with a result that the surfaces of the sheets are brought into contact with the separation roller in a sufficiently large area to ensure that the lowermost sheet is positively fed in the sheet feeding direction.

DESCRIPTION OF THE PREFERRED EMBODIMENTS

Figure 1:
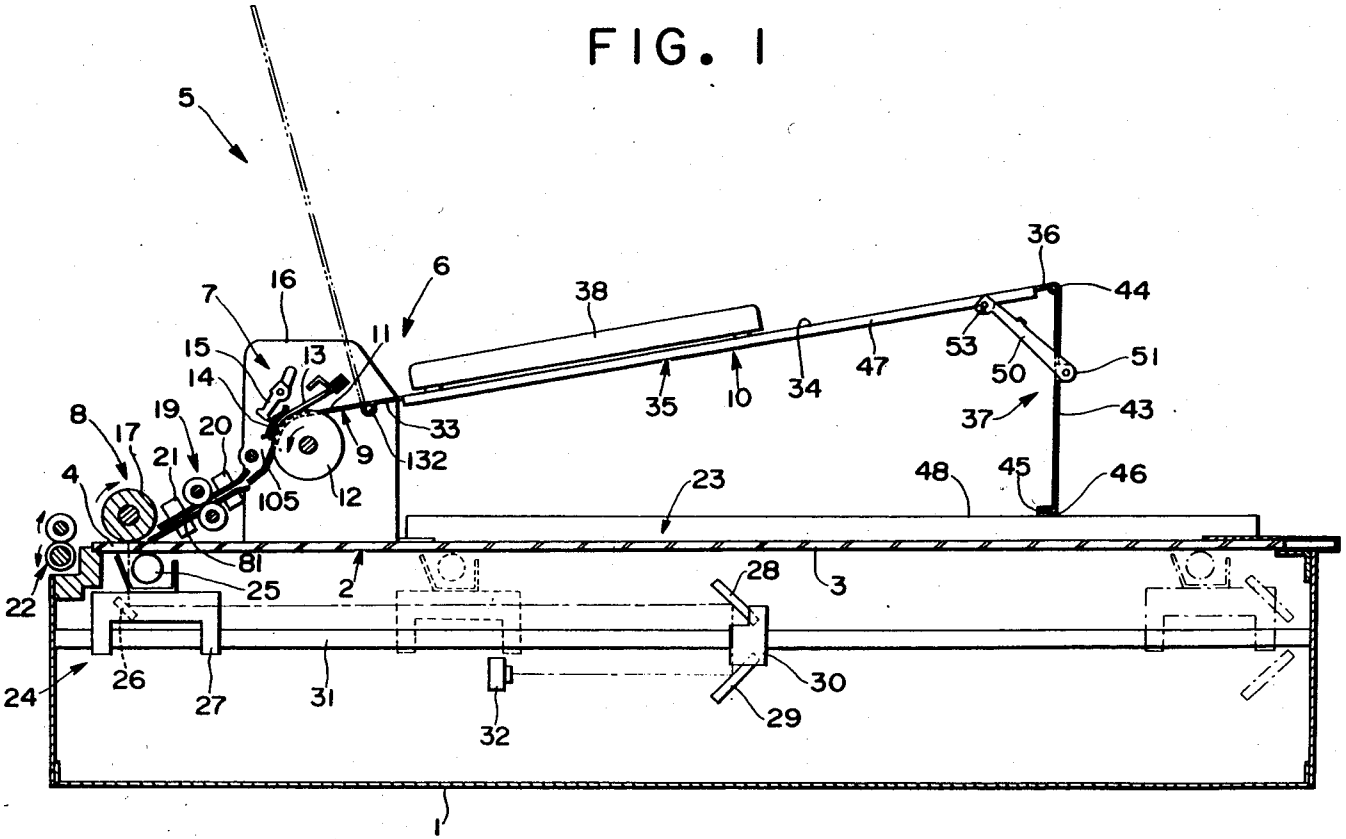
FIG. 1 is a sectional side view of a facsimile transmitter incorporating therein the automatic sheet feeding device comprising one embodiment of the invention.

FIG. 1 shows an embodiment of the invention as incorporated in a facsimile transmitter.

The facsimile transmitter comprises a casing 1 of a read-out section having a contact glass member 2 secured to an upper portion thereof. The contact glass member 2 includes a book document section 3 for placing a document in the form of a book thereon, and a target glass section 4 for reading a document in the form of a sheet. An automatic sheet feeding device 5 for automatically separating one document in the form of a sheet from another document in the form of a sheet and feeding same in a sheet feeding direction a is located above the contact glass member 2 and comprises a sheet tray 6 for supporting a stack of documents in the form of sheets, a separating section 7 located leftwardly of the sheet tray 6, and a conveying section 8 located leftwardly of the separating section 7 for conveying the documents in the form of sheets at a predetermined speed.

As subsequently to be described in detail, the sheet tray 6 includes a first sheet support segment 9 which is stationary, and a second sheet support segment 10 movable between an operative position and an inoperative position.

Arranged in the separating section 7 are a separation roller 12 located at a forward end portion of the first sheet support segment 9, a separation member 13 maintained in pressing engagement with an outer peripheral surface of the separation roller 12, a pressing plate 14 for forcing the separation member 13 against the outer peripheral surface of the separation roller 12 in pressing engagement therewith, and a pressure applying arm 15. The separation roller 12 is arranged such that a portion of an outer periphery thereof slightly protrudes from a sheet support surface 11 of the second sheet support segment 10. These parts of the separating section 7 are supported by two side plates 16 (only one side plate 16 is shown in FIG. 1) via support members, not shown.

Arranged in the conveying section 8 are a target roller 17 positioned against the target glass member 4, a pair of scanner feed rollers 19 located in a document passageway 18, a first sensor 20 for sensing a leading end of a document, a second sensor 21 for sensing a trailing end of the document, and a pair of ejecting rollers 22 for ejecting to outside a document that has been read.

In the book document section 3, a document hold-down member 23 movable between an upright position and a lying position is located.

Located in the casing 1 is a read-out optical system 24 comprising a light source 25, a first reflector 26, a second reflector 28, a third reflector 29, a first support member 27 supporting the light source 25 and first reflector 26, and a second support member 30 supporting the second reflector 28 and third reflector 29. The first and second support members 27 and 30 are movably arranged in such a manner that they are guided by a plurality of guide shafts 31 (only one guide shaft 31 is shown in FIG. 1) and driven by a drive unit, not shown. In a sheet document read-out mode in which information contained in documents in the form of sheets is read out for transmission, the two support members 27 and 30 are fixedly secured in solid line positions; in a book document read-out mode in which information contained in documents in bound form is read out for transmission, the first support member 27 moves from a broken line position to a dash-and-dot line position. An optical image of the document reflected by the first reflector 26, second reflector 28 and third reflector 29 is incident on a read-out element 32 immovably located in a predetermined position.

The first sheet support segment 9 of the sheet tray 6 is secured to the side plates 16 and supports thereon leading end portions of a stack of documents in the form of sheets placed on the sheet tray 6. The second sheet support segment 10 is pivotably connected at a forward end edge 33 through an axis 132 to a rear end edge of the first sheet section 9.

Figure 2:
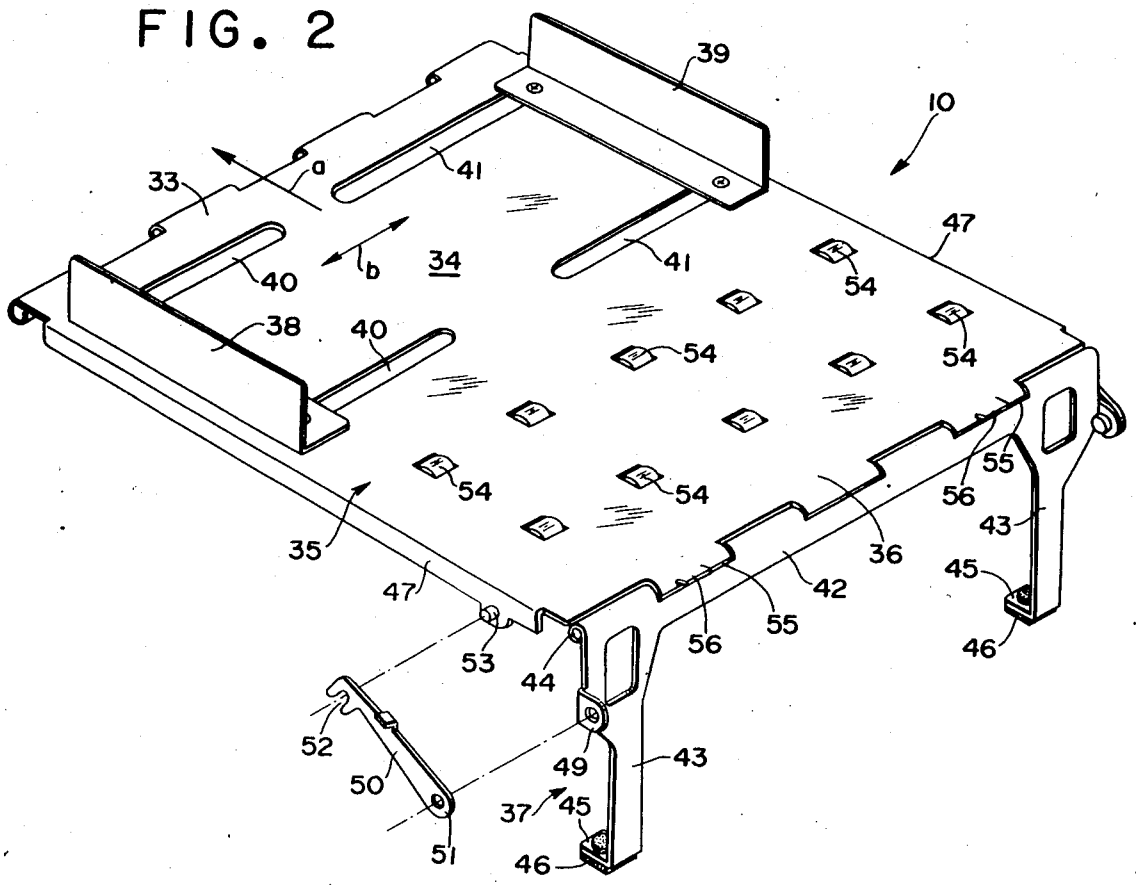
FIG. 2 is a perspective view of the second sheet support segment of the sheet tray.

As shown in FIG. 2, the second sheet support segment 10 includes a support body 35 providing a sheet support surface 34, holding means 37 pivotably connected to a rear end edge 36 of the support body 35, and a pair of sheet guides 38 and 39 spaced apart from each other a distance that can be varied depending on the width of documents supported on the sheet support surface 34. The support body 35 has a sufficiently large area to support on the sheet support surface 34 documents of a maximum size that can be fed in the sheet feeding direction. The sheet guides 38 and 39 which are movable, as shown in FIG. 2, in a direction b which is perpendicular to the sheet feeding direction a is connected via guide slots 40 and 41 to connecting means, not shown, located on a bottom surface of the support body 35 in such a manner that as one of the sheet guides 38 and 39 is moved in one direction, the other sheet guide moves in an opposite direction. A downwardly bent portion 47 is connected to either side of the support body 35 for hiding the connecting means on the bottom surface of the support body 35.

The holding means 37 comprises a main body 42 and two legs 43. The main body 42 includes an end edge complementary in shape with the rear end edge 36 of the support body 35 and supported by a shaft 44 for pivotal movement with respect to the support body 35. The two legs 43 extend from the end edge of the main body 42 at opposite sides and each have a bent forward end portion 45. A slip preventing member 46 formed of rubber or other material having a high friction coefficient is securedly fitted to each bent forward end portion 45. The legs 43 have a length large enough to enable the second sheet support segment 10 to be positioned, when the slip preventing members 46 are placed on a top surface 48 of a document hold-down member 23 as shown in FIG. 1, in such a manner that the sheet support surface 11 of the first sheet support segment 9 and the sheet support surface 34 of the second sheet support segment 10 is located in one tilting plane. The invention is not limited to this arrangement and the sheet support surfaces 11 and 34 may, instead of being located in one plane, be located in two separate planes which may tilt toward each other in the form of a valley having a bottom at the axis 132. Thus, the legs 43 may have a length greater than that shown in FIG. 1.

In the embodiment shown and described hereinabove, a locking arm 50 serving as a locking member is pivotably connected at a base 51 to a bent portion 49 of each leg 43, and formed at its free end with a cutout 52. Each downwardly bent portion 47 of the support body 35 has a locking pin 53 secured thereto. The cutout 52 of each locking arm 50 is brought into locking engagement with the corresponding locking pin 53 of the downwardly bent portion 47 when the holding means 37 is connected to the support body 35 as shown in FIG. 1, so that the holding means 37 will hold the support body 35 in place. However, it is not essential that the holding means 37 be used. The reason will be described in detail when the operation of the embodiment is described.

Referring to FIG. 2 again, a plurality of guide rollers 54 are located in a rearward portion of the support body 35 and supported for rotation in such a manner that each guide roller 54 has a portion of its outer peripheral surface extending upwardly from the sheet support surface 34 of the support body 35. The plurality of guide rollers 54 have the function of lessening friction between a bottom surface of the document and the sheet support surface 34 when the document is of a large size.

The separating section 7 of the automatic sheet feeding device 5 will now be described in detail.

Figure 3:
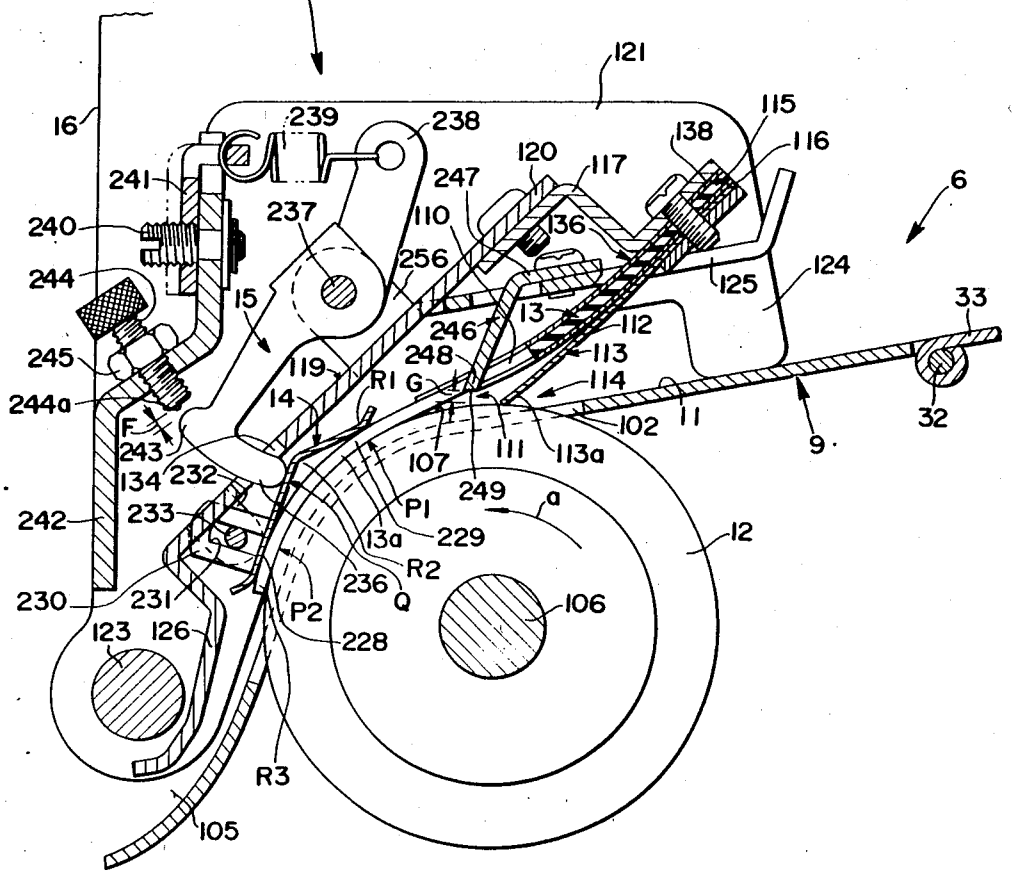
FIG. 3 is a sectional side view of the embodiment of the automatic sheet feeding device in conformity with the invention shown in FIG. 1.
Figure 4:
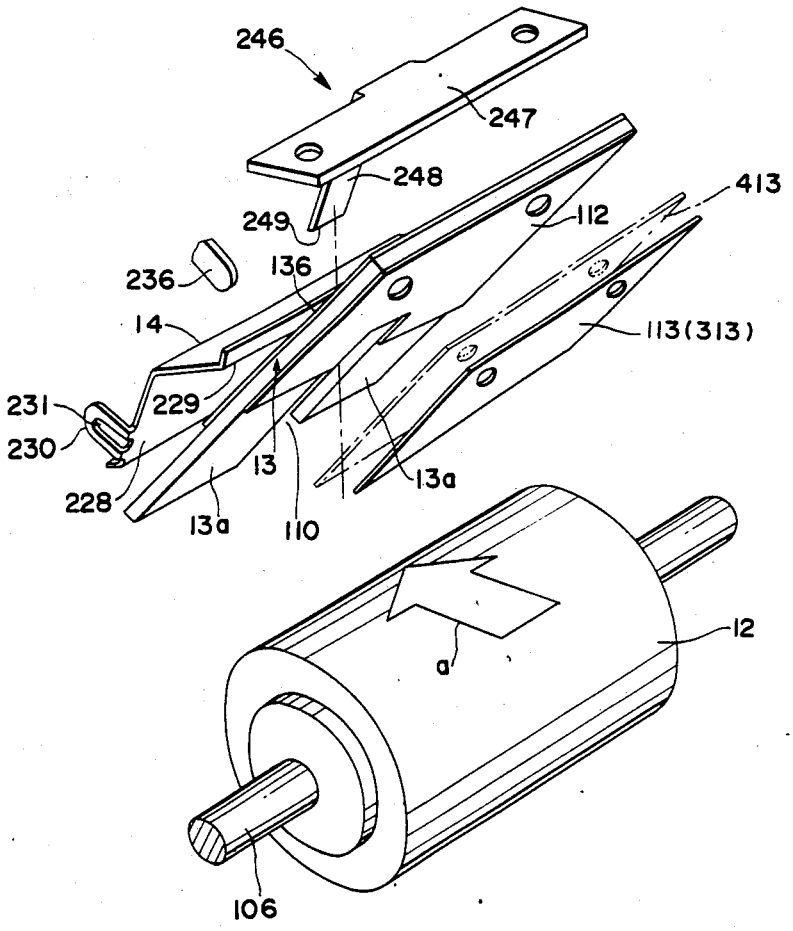
FIG. 4 is an exploded perspective view of the essential portions of the automatic sheet feeding device shown in FIG. 3.

Referring to FIGS. 3 and 4, an opening 102 is formed in a forwardend portion of the first sheet support segment 9 of the sheet tray 6, and the separation roller 12 formed of rubber or other suitable material having a high friction coefficient is located in a position in which a portion of an outer periphery of the roller 12 protrudes upwardly through the opening 102 to be disposed above the sheet support surface 11. The forward end portion of the first sheet support segment 11 extends downwardly beyond the opening 102 to define a document passageway 105 connected to the document passageway 18 (see FIG. 1). The separation roller 12 is supported by a support shaft 106 driven for rotation by a drive unit, not shown, and rotates in the document feeding direction a. Maintained in contact with a surface portion 107 of the protruding portion of the outer periphery of the separation roller 12 is a free end portion **13*a* of the separation member 13 which is formed of rubber or other suitable material having a high friction coefficient. As shown in FIG. 4, the separation member 13 is formed in a widthwise central portion thereof with a cutout 110 extending in a direction perpendicular to the document feeding direction a, so that the separation member 13 is substantially in the form of a letter U in a lying position. A back pressure applying plate 136 is located at the back (a top surface in FIG. 4) of the separation member 13, and a base 138 of the back pressure applying plate 136 and a base 115 of the separating member 13 are secured to a bracket 117, as shown in FIG. 3. The back pressure applying plate 136** is formed of a material of relatively high resilience, such as a thin sheet of steel.

A free end portion **13*a* of the separation member 13 is maintained in surface-to-surface contact with the surface portion 107 of the protruding portion of the outer periphery of the separation roller 12, so as to define a main wedge-shaped space 111 between the separation roller 12 and separation member 13. A slide plate 112 formed of a material, such as a tape of tetrafluoroethylene, a film of polyester, a thin sheet of steel, etc., which as a surface of low friction is adhesively attached to a bottom surface of the separation member 13 which faces the main wedge-shaped space 111**.

Located in the main wedge-shaped space 111 is a sheet pressing member 113 having a base 116 which is secured, together with the base 115 of the separation member 13, to the bracket 117. As shown in FIG. 4, the sheet pressing member 113 is equal to or larger than the separation member 13 in width, and is formed of a sheet of a material of suitable resilience having a surface of low friction, such as a thin sheet of steel, a thin sheet of phosphor bronze, etc. As shown in FIG. 3, the sheet pressing member 113 includes a forward end portion **113*a* which is resiliently brought into contact with the surface portion 107 of the protruding portion of the outer periphery of the separation roller 12 to define an auxiliary wedge-shaped space 114 between the pressing member 113 and separation roller 12. The position in which the forward end portion 113*a* of the separation member 13 is brought into contact with the surface portion 107 of the separation roller 12 is located upstream of the position in which the free end portion 13*a* of the separation member 13 is maintained in contact with the surface portion 107**, with respect to the document feeding direction a.

The bracket 117 is secured to one end portion 120 of a support member 119 which in turn is secured to two side plates 121 (only one is shown in FIG. 3) of a document separating unit. The side plates 121 are pivotably connected through a shaft 123 to the two side plates 16 (only one is shown in FIG. 3) of a main body of the automatic sheet feeding device 5, and urged by biasing means, not shown, to move in a direction in which legs 124 of the side plates 112 are brought into contact with a portion of the sheet support surface 11 which does not contribute to feeding of a document. The support member 119 includes a document thickness regulating portion 125 extending substantially parallel to the sheet support surface 11 in spaced juxtaposed relation for restricting the thickness of documents allowed to enter the main wedge-shaped space 111 of the stack of documents placed on the sheet tray 6.

Figure 14:
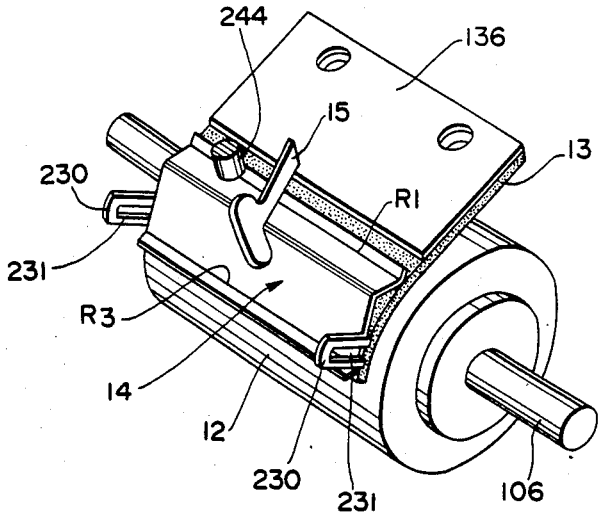
FIG. 14 is a perspective view of the automatic sheet feeding device shown in FIG. 3, showing the essential portions thereof.

A pressing plate 14 is maintained in contact with the back (a top surface in FIG. 3) of the free end portion 13*a* of the separation member 13 and bent in three positions to form three ridges $R_1$, $R_2$ and $R_3$ extending in a direction perpendicular to the document feeding direction a and spaced apart from each other a suitable distance along the document feeding direction a. The pressing plate 14 which is substantially of the same width as the separation member 13 includes a forward portion 228 located immediately posterior to the ridge $R_3$ located near a forward end of the pressing plate 14 and a rearward portion 229 located immediately anterior to the ridge $R_1$ located near a rearward end of the pressing plate 14 which force the free end portion 13*a* of the separation member 13 against the surface portion 107 of the protruding portion of the outer periphery of the separation roller 12. The pressing plate 14 is formed, as shown in FIG. 14, with two support portions 230 each projecting from one of opposite sides of the pressing plate 14 at its forward end portion in a direction away from the separation roller 12 and having a slot 231. Meanwhile, the support member 119 is formed, as shown in FIG. 3, at an opposite end portion with a pair of upright portions 23 (only one is shown) which extend downwardly to support a guide shaft 233 which is loosely inserted in the slots 231 formed in the support portions 230. This structural arrangement permits the pressing plate 14 to move in pivotal movement about the guide shaft 233 and allows same to move radially of the separation roller 12 within a range restricted by the length of the slots 231.

The pressure applying arm 15 includes a pressure applying portion 236 extending through an opening 134 formed in the support member 119 into contact with the back (a top surface in FIG. 3) of the pressing plate 14. The pressure applying arm 15 is pivotably supported by a shaft 237 supported by a pair of upright portions 256 (only one is shown) of the support member 119 and has connected to one end 238 thereof one end of a pressure applying spring 239 which is connected at an opposite end to a support member 241 secured by an adjusting screw 240 to a stay 242. As the adjusting screw 240 is turned, the support member 241 moves forwardly or backwardly depending on the direction in which the screw 240 is turned, to vary the pressure at which the pressure applying spring 239 is set. The pressure applying arm 15 is urged by the biasing force of the pressure applying spring 239 to move in pivotal movement in a direction in which pressure is applied to the pressing plate 14. Thus, the free end portion 13*a* of the separation member 13 is forced by the portions 228 and 229 of the pressing plate 14 at pressing points $P_2$ and $P_1$, respectively, against the surface portion 107 of the protruding portion of the outer periphery of the separation roller 12, with a result that the free end portion 13*a* is maintained in surface-to-surface contact with the surface portion 107 of the separation roller 12. The pressing plate 14, pressure applying arm 15 and pressure applying spring 239 constitute pressure applying means for urging the separation member 13 against the separation roller 12.

The stay 242 which connects the pair of side plates 16 together has threadably connected thereto in a position which is juxtaposed against the back of the pressure applying portion 236 of the pressure applying arm 15 a regulating member 244 which keeps the free end portions 13*a* of the separation member 13 from moving away from the surface portion 107 of the separation roller 12 a distance greater than a predetermined value by restricting the pivotal movement of the pressure applying arm 15 in a clockwise direction in FIG. 3. The regulating member 244 is secured in position by a lock nut 245 after having its position adjusted. A clearance F is defined between the back 243 of the pressure applying portion 236 of the pressure applying arm 15 and a forward end 244*a* of the regulating member 244. The clearance F is set at a value which is greater than the maximum thickness of a document that is fed and smaller than the sum of the thicknesses of two documents each having the maximum thickness. Thus, the clearance F will have one of several values which may vary depending on the thickness of the document handled. The value of the clearance F is usually in the range between about 0.07 and 0.3 mm.

As described hereinabove, the pressing plate 14 is operative to force the free end portion 13*a* of the separation member 13 in two positions including the portions 228 and 229 against the surface portion 107 of the protruding portion of the outer periphery of the separation roller 12, so that the two pressing points $P_1$ and $P_2$ perform an important function in separating the lowermost document from the overlying documents.

The pressure applied to the portions 228 and 229 of the pressing plate 14 by the pressure applying portion 236 of the pressure applying arm 15 may vary depending on the location of a position Q in which the pressure applying portion 236 is positioned against the pressing plate 14. However, so long as the position Q is located on a center axis of the pressing plate 14 equidistantly spaced apart from opposite side edges of the plate 14, a uniform pressure is applied to the two portions 228 and 229 widthwise of the document. However, if the position Q shifts along the sheet feeding direction a, the pressure applied to the portion 228 located downstream of the portion 229 with respect to the sheet feeding direction a would vary from the pressure applied to the portion 229 which is disposed upstream of the portion 228. Stated differently, the pressures applied to the portions 228 and 229 may vary from each other depending on changes taking place in the distance between the position Q and the pressing points $P_1$ and $P_2$. For example, if the distance between the position Q and the pressing point $P_1$ were smaller than the distance between the position Q and the pressing point $P_2$, then the pressure applied to the portion 229 would be greater than that applied to the portion 228.

Whether the same pressure is applied to the pressing points $P_1$ and $P_2$ or a pressure applied to one of the pressing points $P_1$ and $P_2$ is made higher than that applied to the other pressure point is decided depending on the nature of the documents handled. In adjusting the pressure, the position Q in which pressure is applied by the pressure applying portion 236 of the pressure applying arm 15 to the pressing plate 14 is adjusted, as described hereinabove. More specifically, the upright portions 232 of the support member 119 may be made movable in the document feeding direction a with respect to the support member 119, so as to vary the position of the shaft 233 by moving the upright portions 232 in this way. Alternatively, the pressure applying arm 15 may be made movable in the document feeding direction a.

A gate member 246 having a base 247 secured to the back (a top surface in FIG. 3) of the document thickness regulating member 125 is in the form of a letter T as shown in FIG. 4, when viewed in the document feeding direction a. A sheet abutting portion 248 bent downwardly from the base 247 extends through the cutout 110 formed in the separation member 13 into the main wedge-shaped space 111. A gap G is formed between a lower end 249 of the sheet abutting portion 248 and the surface portion 107 of the protuding portion of the outer periphery of the separation roller 12. The gap G is set at a value large enough to allow one or a plurality of documents to pass therethrough. The separation roller 12 is disposed in a central portion of documents placed on the sheet tray 6 with respect to the width of the documents, and the separation member 13 is also disposed in the central portion of the documents with respect to the width thereof, so that the gate member 246 is also disposed in the central portion of the sheet tray 6 with respect to the width of the documents.

As described hereinabove, the separation roller 12 and separation member 13 are each formed of a material of high friction. In the automatic sheet feeding device 5 according to the invention, the materials and surface coarseness of the separation roller 12 and separation member 13 are selected such that the relation $\mu_1 > \mu_2 > \mu_3$ holds wherein $\mu_1$, $\mu_2$ and $\mu_3$ are a force of friction exerted by the separation roller 12, a force of friction exerted by the separation member and a force of friction exerted by one document against the other document respectively. Thus, when a plurality of documents enter between the separating roller 12 and separation member 13 which are maintained in pressing contact with each other, only the document kept in contact with the separation roller 12 exerting a force of friction of the highest magnitude is fed in the document feeding direction a by the feed roller 12 while other documents are kept from moving in the sheet feeding direction a by the friction between the separation roller 13 and the documents and the friction between the documents themselves.

The construction of the embodiment of the automatic sheet feeding device in conformity with the invention shown in FIGS. 1–4 and 14 and the construction of a facsimile transmitter incorporating therein the aforesaid embodiment of the invention have been described. Operation of the automatic sheet feeding device of the aforesaid construction is as follows.

Figure 5:
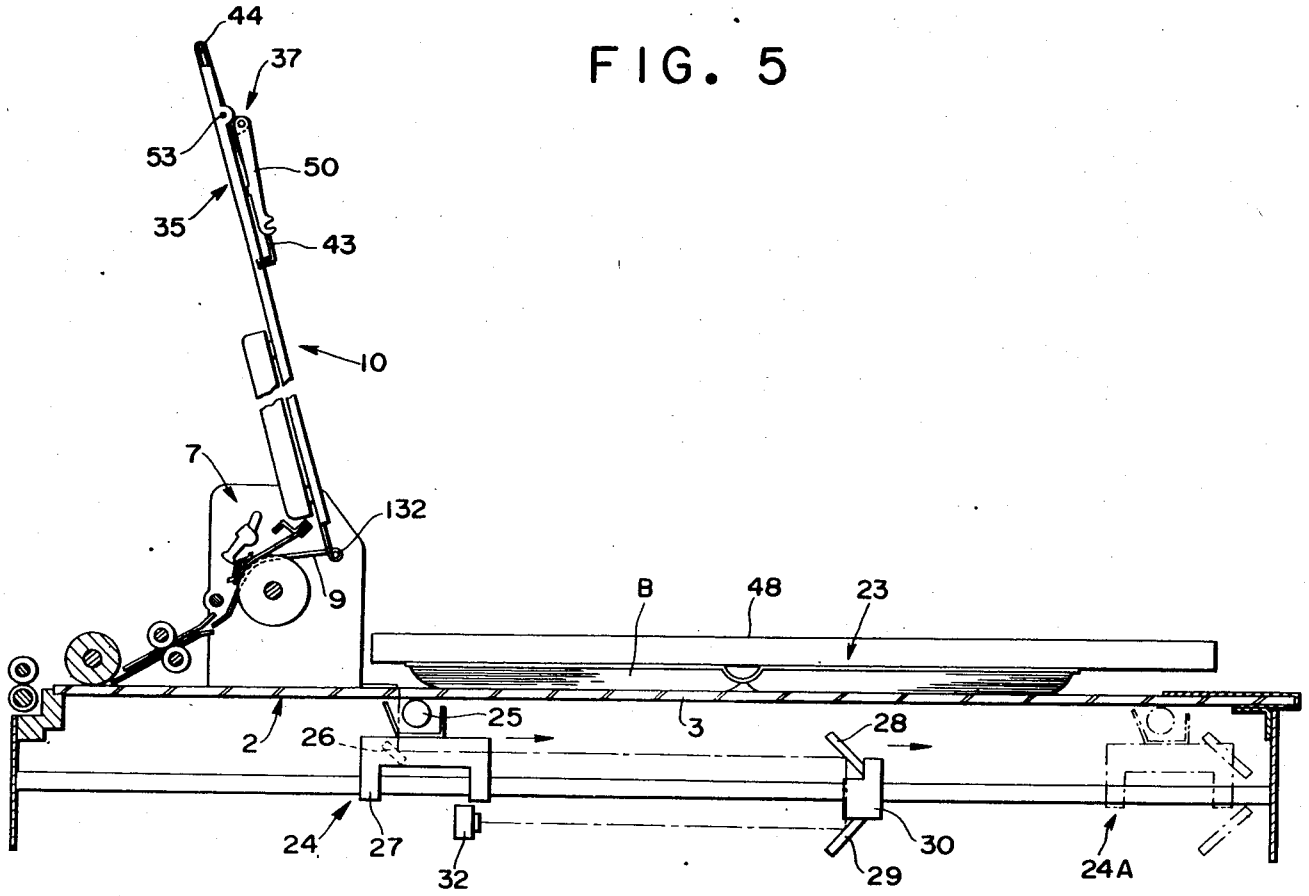
FIG. 5 is a side view of automatic sheet feeding device shown in FIG. 3, showing the second sheet support segment of the sheet tray moved to an inoperative position.

In the description presently to be made, a solid line position in which the sheet support surface 34 of the second sheet support segment 10 of the sheet tray 6 is flush with the sheet support surface 11 of the first sheet support segment 9, as shown in FIG. 1, will be referred to as an operative position of the second sheet support segment 10, and a dash-and-dot line position in which the second sheet support segment 10 is angled, as shown in FIG. 5, with respect to the first sheet support segment 9 after being pivotally moved into such position about the axis 132 from the solid line position will be referred to as an inoperative position of the second sheet support segment 10.

In the facsimile transmitter shown in FIG. 1, images are transmitted either in a sheet document image transmitting mode or in a book document image transmitting mode, and selection of the mode is effected by a command issued by a control unit, not shown. The operation of an image transmitting operation performed in these two modes will now be described.

(1) Sheet Document Image Transmitting Mode

When this mode is selected by a selection switch, not shown, the read-out optical system 24 is fixed in place in a solid line position, and the second sheet support segment 10 is moved to the operative position in solid lines shown in FIG. 1. A stack of documents in the form of sheets, not shown, is placed on the sheet tray 6 in such a manner that the leading end portions of the documents are located on the first sheet support segment 9 and a lowermost sheet of the stack is brought into contact with the outer peripheral surface of the separation roller 12. Thus, the major portion of the stack of documents is located on the second sheet support segment 10, and the sheet guide members 38 and 39 are moved to conform to the width of the stack of documents placed on the sheet tray 6.

After the stack of documents is placed on the sheet tray 6 as described hereinabove, a feeding signal is issued by the control unit to rotate the separation roller 12 counterclockwise as indicated by an arrow, so as to move a plurality of documents from the stack of documents in the sheet feeding direction a to bring their leading end portions into pressing contact with the separation roller 12 and the separation member 13. Of the plurality of documents, only the lowermost document is separated from the rest of the documents and fed into the document passageway 18 by the feeding force produced by friction. As the leading end of the separated document is sensed by the first sensor 20, the pair of scanner feed rollers 19 and the target roller 17 begin to rotate. After the leading end of the document is bitten by the pair of rollers 19, the supply of motive force to the separation roller 12 to drive same for rotation is interrupted.

The pair of scanner feed rollers 19 feeds the document in synchronism with the operation of a facsimile receiver, not shown. The document fed is illuminated by the light source 25 and light reflected by the document is reflected by the first reflector 26, second reflector 28 and third reflector 29 before the light is incident on the read-out element 32. As a trailing end of the document is sensed by the second sensor 21, a command is given to rotate the separation roller 12 again to perform another document separating and feeding operation.

In the sheet document image transmitting mode described hereinabove, the second sheet support segment 10 is held in the operative position by the holding means 37. At this time, the second sheet support segment 10 can be held in the operative position even if the locking arms 50 were not provided. More specifically, as shown in FIG. 2, stoppers 56 engaging an upper edge 55 of the main body 42 of the holding means 37 may be connected to the rear edge 36 of the support body 35, to keep the holding means 37 from pivotally moving counterclockwise from a position in which it is located in FIG. 1. When the second sheet support segment 10 is pivotally moved from the inoperative position shown in FIG. 5 to the operative position shown in FIG. 1, the holding means 37 is pivotally moved by its own weight about the shaft 44 to a position in which it is located perpendicularly with respect to the top surface 48 of the document hold-down member 23. A portion of a load is applied to the legs 43. However, since the load is applied in a direction perpendicular to the document hold-down member 23 and the slip preventing members 46 are in contact with the top surface 48 of the document hold-down member 23, the holding means 37 is kept from moving pivotally about the shaft 44. In place of providing the stoppers 56, the holding means 37 may be connected to the support body 35 by a string or a chain to keep it from moving pivotally.

(2) Book Document Image Transmitting Mode

When this mode is selected, the read-out optical system 24 is moved by a drive unit, not shown, to a start position shown in solid lines in FIG. 5 to stand by.

Meanwhile, the second sheet support segment 10 is moved pivotally counterclockwise about the axis 132 to the inoperative position shown in FIG. 5. In this case, by releasing the locking arms 50 from the respective locking pins 53, the holding means 37 can be moved pivotally by its own weight clockwise in FIG. 2 about the shaft 44 into contact with a bottom surface of the support body 35. The second sheet support segment 10 is held in the inoperative position as a portion of the segment 10 is brought into abutting engagement with stoppers, not shown, located in suitable positions in the separating section 7.

Upon the second sheet support segment 10 being moved to the inoperative position, an open space exists above the top surface 48 of the document hold-down member 23. Then, the document hold-down member 23 is removed to expose the book document section 3 of the contact glass member 2 on which a document B in the form of a book is placed, with the document image to be read facing the contact glass member 2. The document B need not be in the form of a book and may include plastic-film-laminated sheets that defy separation and feeding by any automatic process of document feeding.

After the document B is placed in position, a read-out signal is issued by the control unit, to move the read-out optical system 24 rightwardly in FIG. 1. The movements of the first support member 27 and second support member 30 are timed such that when the velocity of the former is V, that of the latter is ½ V. The image of the document B is illuminated by the light source 25 and read by the read-out element 32 after the light is reflected successively by the first reflector 26, second reflector 28 and third reflector 29. Read-out of the image of the document B is finished by the time the optical system 24 reaches an end position 24A. From the end position 24A, the optical system 24 is restored to the starting position.

As described hereinabove, when images of the documents in the form of sheets are to be transmitted, the sheet document image transmitting mode is selected, and the documents placed in a stack on the second sheet support segment 10 of the sheet tray 6 are separated from each other in the separating section 7 before being fed toward the target glass member 4. The operation of separating one document from another and feeding same which is performed in the separating section will now be described in detail.

Figure 6:
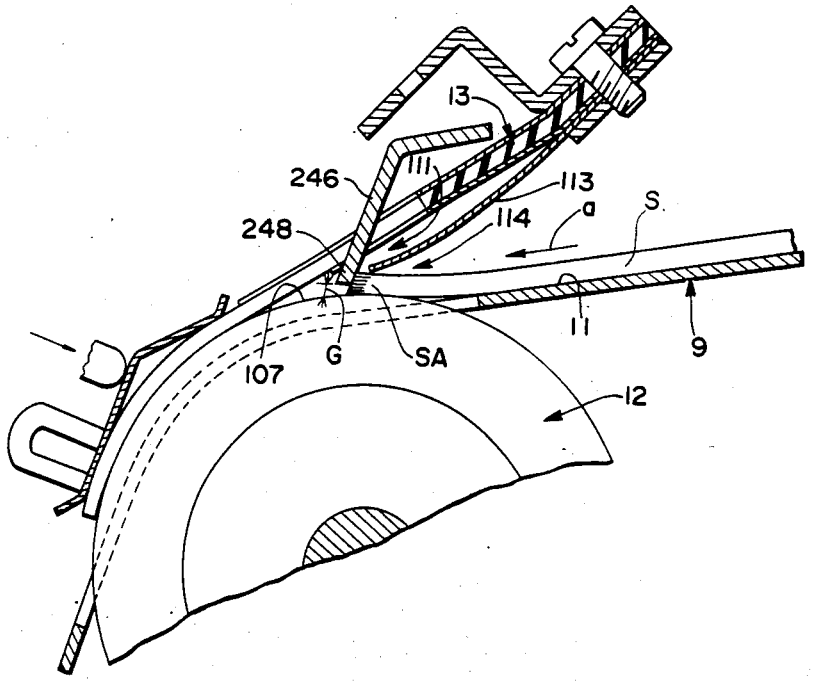
FIGS. 6–10 are sectional side views in explanation of the operation of the automatic sheet feeding device shown in FIG. 3.

FIG. 6 shows the essential portions of the separating section 7 shown in FIG. 3, and shows, in particular, a stack of sheets S placed on the sheet support surface 11 of the first sheet support segment 9. The stack of sheets S placed on the sheet support surface 11 of the first sheet support segment 9 moves in the sheet feeding direction a. A leading end SA of the stack of sheets S enters the auxiliary wedge-shaped space 114, from which it enters the main wedge-shaped space 111 after causing the pressing member 113 in contact with the the surface portion 107 of the protruding portion of the outer periphery of the separation roller 12 to flex and move upwardly in FIG. 6, until it abuts against the sheet abutting portion 248 of the gate member 246 and its movement is interrupted. At this time, the leading end portion of the stack of sheets S is forced against the surface portion 107 of the protruding portion of the outer periphery of the separation roller 12 by the flexing and upwardly moving pressing member 113. Thus, as the separation roller 12 is rotated in the sheet feeding direction a, friction between the lowermost sheet of the stack of sheets S and the surface portion 107 produces a feeding force high enough to move the lowermost sheet in the sheet feeding direction a.

Figure 7:
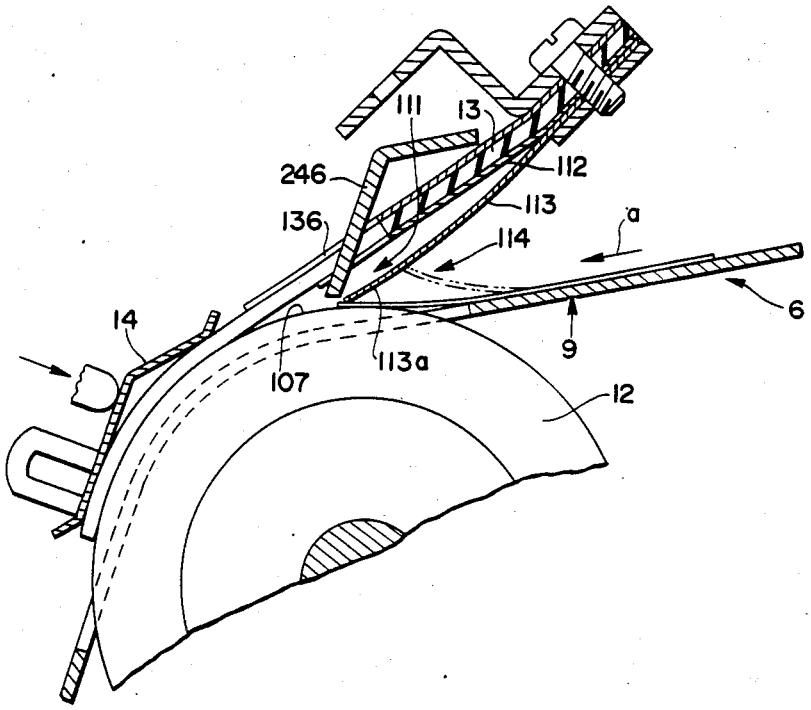

However, when a document placed on the first sheet support segment 9 of the sheet tray 6 is curling upwardly in its leading end portion as indicated by dash-and-dot lines in FIG. 7, the leading end of the document abuts against a bottom surface of the pressing member 113 and its further forward movement is prevented in the main wedge-shaped space 111 after the document has entered the auxiliary wedge-shaped space 114. At this time, the upwardly curling leading end portion of the document is pressed by a leading end portion **113*a* of the pressing member 113, so that a sufficiently large area of contact to produce a sheet feeding force is maintained between the document and the surface portion 107 of the separation roller 12 even if the leading end portion of the document is curling in a direction away from the outer peripheral surface of the separation roller 12. At the same time, the resilience of the pressing member 113 produces between the document and the surface portion 107 of the separation roller 12 friction high enough to produce a sheet feeding force for moving the document in the sheet feeding direction a. Thus, the document having an upwardly curling leading end portion can be positively moved in the sheet feeding direction a. In describing the operation of feeding a document having an upwardly curling forward end portion, reference has been made to the single document shown in FIG. 7. It is to be understood, however, that the operation of feeding a plurality of documents, such as the stack of documents S shown in FIG. 6, could be performed smoothly even if their leading end portions, such as the leading end portions SA shown in FIG. 6**, were curling upwardly.

Figure 8:
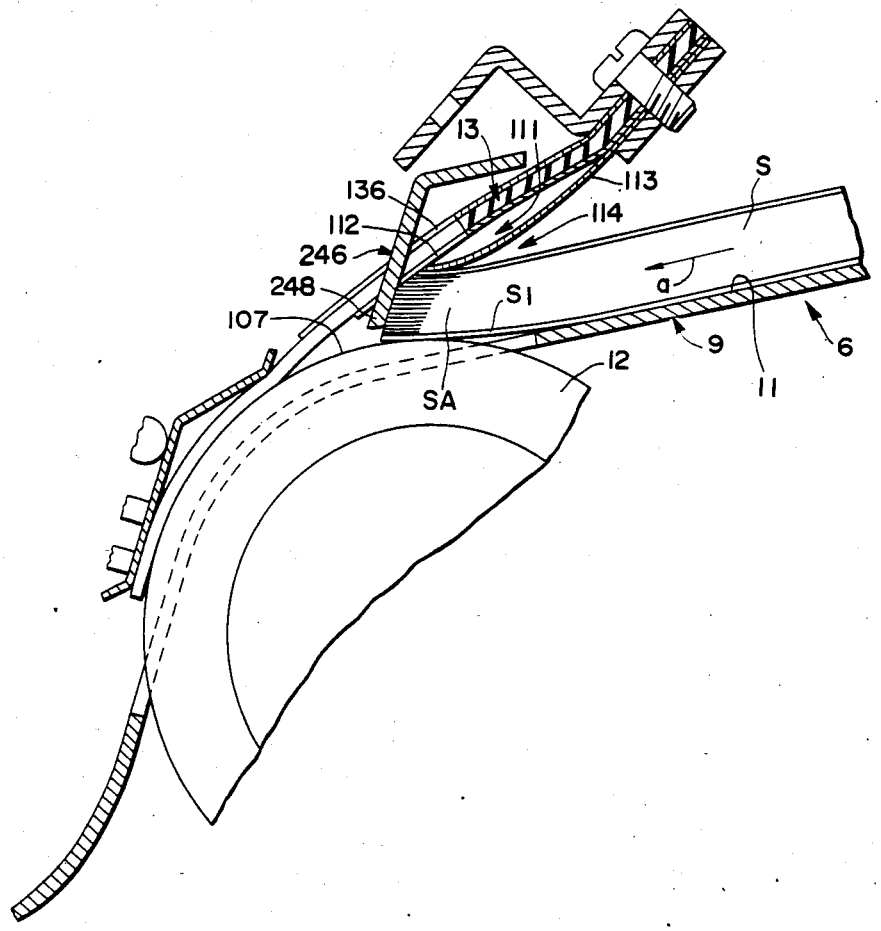

FIG. 8 shows a multiplicity of documents piled in a stack S on the first sheet support segment 9 of the sheet tray 6. The function of the back pressure applying member 136 located on the back (the top surface) of the separation member 13 will be described by referring to FIG. 8. In the figure, the stack of documents S moves in the sheet feeding direction a on the first sheet support segment 9 into the auxiliary wedge-shaped space 114, where it causes the sheet pressing member 113 to flex upwardly to further enter the main wedgeshaped space 111, in the same manner as described by referring to FIG. 6. In the case of the stack of documents S shown in FIG. 6, the leading end SA of the stack of documents S directly abuts against the sheet abutting surface 248 of the gate member 246. However, when the stack of documents S contains a multiplicity of documents and large in thickness as shown in FIG. 8, the leading end SA of the stack of documents S abuts against the separation member 13 before being brought into abutting engagement with the sheet abutting surface 248. Thus, when the leading end SA abuts against the sheet abutting surface 248, the separation member 13 has been caused to flex upwardly by the leading end SA of the stack of documents.

If the separation member 13 is flexed upwardly, the area of the surface of contact between the separation member 13 and the separation roller 12 and hence the area of the surface of contact between the lowermost document of the stack of documents S and the separation roller would be reduced, causing a decrease to occur in the sheet feeding force produced by friction. Thus, it might become impossible to feed the document at all. This disadvantage is obviated by the provision of the back pressure applying member 136 of relatively high resilience according to the invention which is located on the back of the separation member 13. More specifically, even if the stack of documents S of a large thickness enters the main wedge-shaped space 111 and urges the separation member 13 to move away from the surface portion 107 of the protruding portion of the outer periphery of the separation roller 12, the reaction of the back pressure applying member 136 forces the separation member 13 against the stack of documents S. Thus, the lowermost document of the stack of documents S is caused to press against the surface portion 107 of the protruding portion of the outer periphery of the separation roller 12, and friction between them produces a sufficiently high sheet feeding force to move the lowermost sheet in the sheet feeding direction a. Thus, the problem noted hereinabove is solved.

Flexing of the separation member 13 has been described as being caused by the large thickness of the stack of documents S entering the main wedge-shaped space 111 by referring to FIG. 8. However, it should be noted that the large thickness of a stack of documents is not the only reason for the separation member 13 to flex upwardly. For example, the separation member 13 might flex upwardly if the leading end of the stack of documents were curling upwardly although its thickness is not so great.

Figure 9:
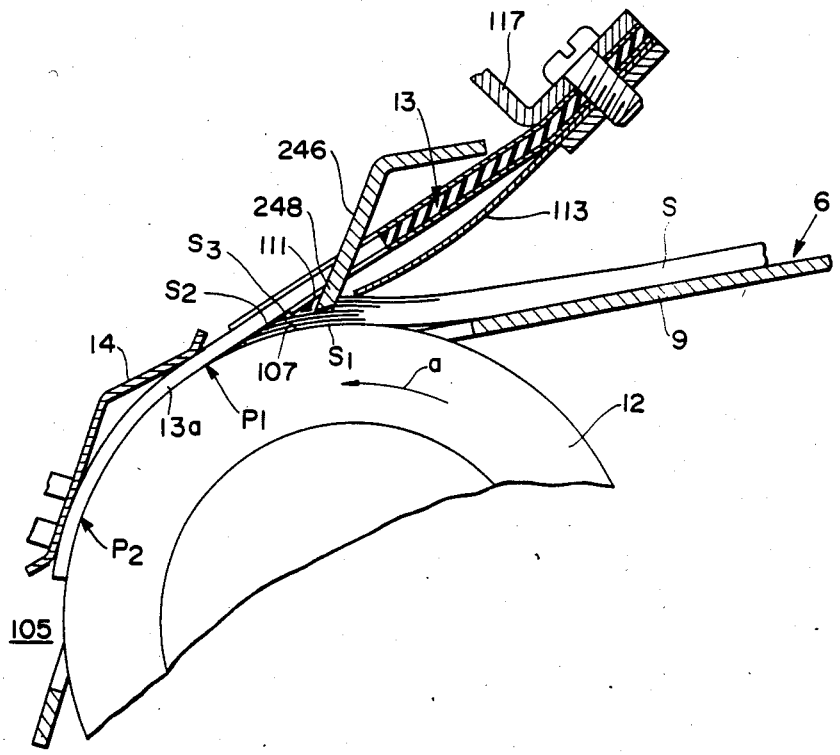

After the stack S of a relatively smaller number of documents shown in FIG. 6 or the stack S of a relatively large number of documents shown in FIG. 8 has moved to a position on the first sheet support segment 9 in which the leading end of the stack S is positioned against the gate member 246, a feeding commencing switch, not shown, is actuated to cause the separation roller 12 to start rotating in the sheet feeding direction a, as shown in FIG. 9. As the separation roller 12 rotates, a plurality of documents that can pass through the gap G (see FIGS. 4 and 6), which are three documents including the lowermost documents $S_1$ maintained in contact with the surface portion 107 and documents $S_2$ and $S_3$ overlying the document $S_1$, move through the gap G into the main wedge-shaped space 111. Leading ends of the three documents $S_1$, $S_2$ and $S_3$ that have entered the main wedge-shaped space 111 abut against a bottom surface of the separation member 13. As described hereinabove, the force of friction $\mu_1$ exerted by the separation roller 12, the force of friction $\mu_2$ exerted by the separation member 13 and the force of friction $\mu_3$ exerted by one document against another has the relation $\mu_1 > \mu_2 > \mu_3$, so that the lowermost document $S_1$ is separated from the overlying document $S_2$ by the force of friction $\mu_1$ overcoming the force of friction $\mu_3$ and moves between the separation member 13 and the surface portion 107 of the separation roller 12 to a position in which the document $S_1$ is pressed between the separation member 13 and the surface portion 107 at the pressing points $P_1$ and $P_2$. After passing through the pressing points $P_1$ and $P_2$, the document $S_1$ moves into the document possageway 105 through which it is fed into the conveying section 8 (see FIG. 1).

Of the documents that have passed through the gap, the documents $S_2$ and $S_3$ are stopped in their forward movement by the bottom surface of the separation member 13 because their forces of friction have the relation $\mu_2 > \mu_3$. As soon as the lowermost document $S_1$ moves into the document passageway 105 and its trailing end is released from a leading end of the overlying document $S_2$, the free end portion 13*a* of the separation member 13 is made to press against the protruding outer periphery of the separation roller 12 by the pressing plate 14, so that the document $S_2$ is pressed between the separation member 13 and the separation roller 12 at the pressing points $P_1$ and $P_2$ and its movement in the sheet feeding direction a can be prevented.

In describing the operation of feeding one document after another, the documents $S_1$, $S_2$ and $S_3$ have been described as if they had a relatively low coefficient of friction acting between them or they separated themselves from each other with difficulty. However, if the documents $S_1$, $S_2$ and $S_3$ have a relatively low coefficient of friction or they separate themselves from each other with ease, then only the lowermost document $S_1$ readily separates itself from the overlying documents as it is fed by the frictional feeding force of the separation roller 12 and passes through the gap G. After passing through the gap G, the movement of the document $S_1$ of a relatively low coefficient of friction is no different from the movement of the document $S_1$ described hereinabove as having a relatively high coefficient of friction.

The provision of the gate member 246 offers the advantage that, regardless of whether the coefficient of friction acting between the documents is high or low, a relatively small number of documents are fed through the gap G and the documents thus fed move directly into the pressing points $P_1$ and $P_2$ between the separation member 13 and the separation roller 12. Thus, the separation member 13 is prevented from moving away from the outer peripheral surface of the separation roller 12 a larger distance than is necessary, and the pressing plate 14 effectively causes the separation member 13 to force the documents against the separation roller 12, to enable one document after another to be positively fed in the sheet feeding direction a. Also, entry of a large number of documents into a portion of the main wedge-shaped space 111 which is located downstream of the gate member 246 can be prevented, thereby making it possible to avoid a redundant document feeding or no document feeding experienced in the prior art.

Figure 10:
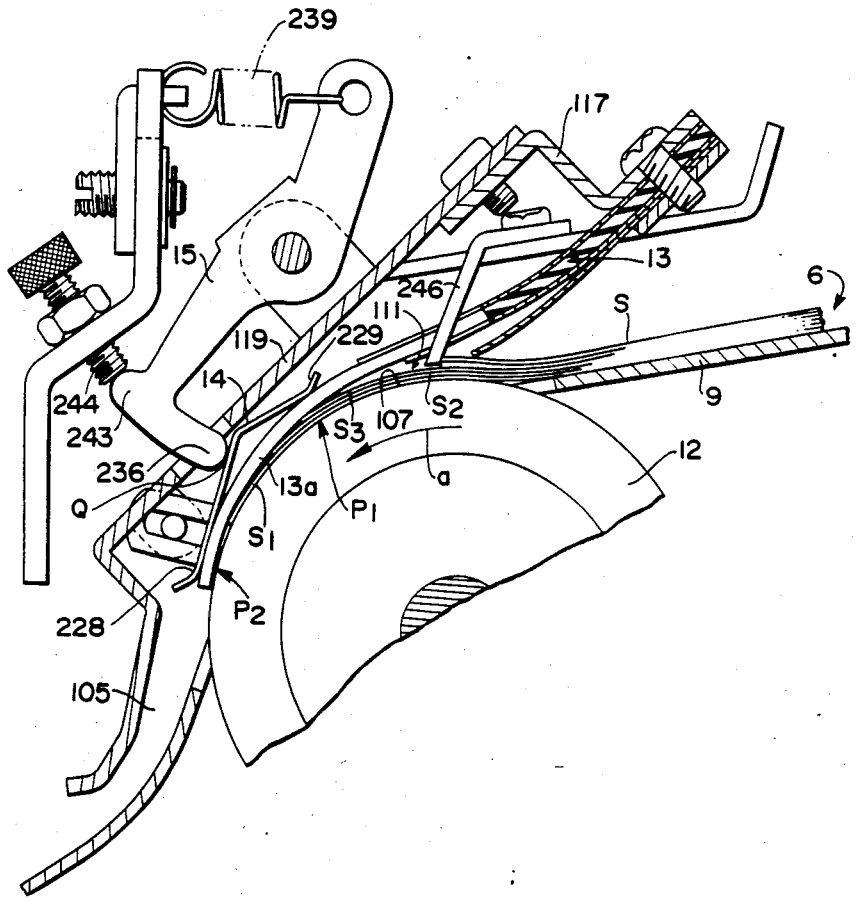

When the documents are of the type which separate themselves from each other with great difficulty, the documents $S_1$, $S_2$ and $S_3$ entering the main wedge-shaped space 111 after passing through the gap G (see FIGS. 3 and 6) push the free end portion 13*a* of the separation member 13 upwardly by their leading ends, as shown in FIG. 10. That is, the documents $S_1$, $S_2$ and $S_3$ urge the separation member 13 to move in a direction in which it moves away from the surface portion 107 of the protruding portion of the outer periphery of the separation roller 12 against the biasing force of the pressure applying spring 239. However, the movement of the free end portion 13*a* is prevented by the regulating member 244 which presses against the back 243 of the pressure applying portion 236 of the pressure applying arm 15.

The movement of the free end portion 13*a* of the separation member 13 in the direction in which it moves away from the separation roller 12 is prevented by the regulating member 244 cooperating with the pressure applying arm 15, so that the function of separating only one document from a plurality of documents and feeding same in the sheet feeding direction a while preventing the forward movement of the rest of the documents is improved. Also, no gap of a size large enough to admit a large number of documents to go through is formed between the free end portion 13*a* of the separation member and the separation roller 12 by the action of the regulating member 244 cooperating with the pressure applying arm 15, so that it is possible to avoid a document jam which might otherwise occur when a large number of documents enter between the free end portion 13*a* of the separation member 13 and the separation roller 12.

Even if the movement of the free end portion 13*a* of the separation member 13 in the direction in which it moves away from the separation roller 12 is prevented by the regulating member 244 cooperating with the pressure applying arm 15, the documents $S_1$, $S_2$ and $S_3$ tend to move into the pressing point $P_1$. At this time, the leading ends of the documents $S_1$, $S_2$ and $S_3$ force the free end portion 13*a* of the separating member 13 at the pressing point $P_1$ against the pressing member 14 to move same upwardly. The force exerted by the leading ends of the documents $S_1$, $S_2$ and $S_3$ on the free end portion 13*a* at the pressing point $P_1$ at this time causes the pressing plate 14 to move counterclockwise in pivotal movement about the position Q in which the pressure applying portion 236 of the pressure applying arm 15 is positioned against the pressing plate 14. Stated differently, the force urging the free end portion 13*a* to move upwardly at the pressing point $P_1$ is converted to a force causing the free end portion 13 to press against the surface portion 107 of the separation roller 12 at the pressing point $P_2$. Thus, when the documents $S_1$, $S_2$ and $S_3$ force their way between the free end portion 13*a* of the separation member 13 and the surface portion 107 of the separation roller 12 and enter a section between the two pressing points $P_1$ and $P_2$, they exert on the free end portion 13*a* a force urging same to move upwardly away from the surface portion 107 of the separation roller 12, and this force acts to cause the free end portion 13*a* to press against the surface portion 107 at the pressing point $P_2$. Thus, after the documents $S_1$, $S_2$ and $S_3$ have passed through the pressing point $P_1$, their further movement to and beyond the pressing point $P_2$, is prevented. However, as the free end portion 13*a* presses against the surface portion 107 at the pressing point $P_2$, friction between the separation roller 12 and the lowermost document $S_1$ increases, so that the lowermost document $S_1$ is positively separated from the other documents $S_2$ and $S_3$ and fed in the sheet feeding direction a. The document $S_1$ separated from the other documents $S_2$ and $S_3$ is moved via the document passageway 105 to the conveying section 8 (see FIG. 1).

By virtue of the aforesaid feature of the invention, when documents having a high coefficient of friction acting between them are placed in a stack on the sheet tray 6, movement of a plurality of documents between the free end portion 13*a* of the separation member 13 and the surface portion 107 of the separation roller 12 to the document passageway 105 is positively prevented at the pressing point $P_1$ or $P_2$, and no redundant document feeding into the document passageway 105 takes place.

Figure 11:
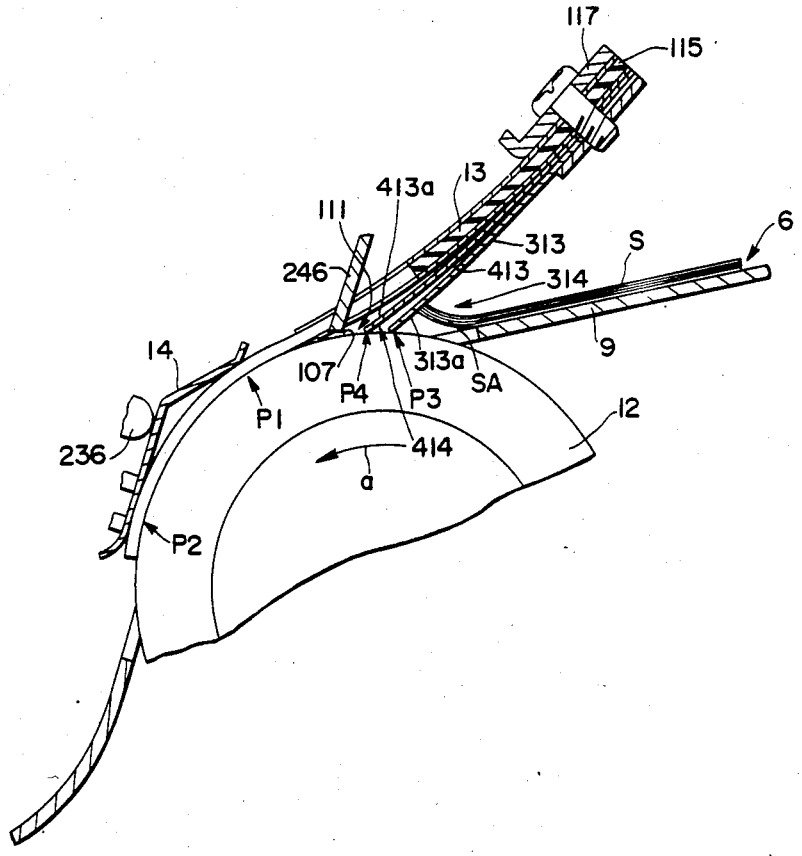
FIG. 11 is a sectional side view of the automatic sheet feeding device comprising another embodiment of the invention.

Another embodiment of the invention will now be described by referring to FIG. 11 in which parts similar to those shown in FIGS. 1–10 will be designated by like reference characters and their detailed description shall be omitted. In this embodiment, two sheet pressing members or a first sheet pressing member 313 and a second sheet pressing member 413 extend into the main wedge-shaped space 111 and have their bases secured to the bracket 117 together with the base 115 of the separation member 13. The first and second sheet pressing members 313 and 413 each have a width substantially equal to or greater than that of the separation member 13 (see FIG. 4). The first and second sheet pressing members 313 and 314 are each formed of a thin sheet of steel or phosphor bronze of suitable resilience having a surface of low friction and have forward end portions 313*a* and 413*a* resiliently engaging the surface portion 107 of the protruding outer peripheral surface of the separation roller 12, so that a first auxiliary wedge-shaped space 314 is defined between the first sheet support segment 9 of the sheet tray 6 and the first sheet pressing member 313 and a second auxiliary wedge-shaped space 414 is defined between the first and second sheet pressing members 313 and 413. The second sheet pressing member 413 located downstream of the first sheet pressing member 313 with respect to the sheet feeding direction a is higher in resilience than the first sheet pressing member 313. Stated differently, the second sheet pressing member 413 presses against the surface portion 107 of the separation roller 12 with a greater force than the first sheet pressing member 313. In the embodiment shown and described hereinabove the sheet pressing members 313 and 413 are two in number, but the invention is not limited to this specific number of sheet pressing members and any number of sheet pressing members may be provided as desired. In FIG. 11, the first and second sheet pressing members 313 and 413 are shown as pressing against the surface portion 107 of the separation roller 12 at pressing points $P_3$ and $P_4$ respectively. Preferably, the pressing points $P_3$ and $P_4$ are positioned such that a circumferential extent of the surface portion 107 separating pressing point 1 from the pressing point 4 is substantially equal to a circumferential extent of the surface portion 107 separating pressing points 3 and 4 from each other.

In the embodiment of the aforesaid construction, when a stack S of documents having leading end portions curling upwardly as shown in FIG. 11 moves toward the main wedgeshaped space 111, leading ends of the documents abut against a bottom surface of low friction of the first pressing member 313 which is relatively low in resilience and are guided thereby, so that they move forwardly while having the upwardly curling forward end portions straightened by the member 313 as they cause the member 313 to flex upwardly. As a result, the leading end portions of the documents of the stack S that are straightened by the member 313 press against the surface portion 107 of the separation roller 12. After the leading ends of the documents of the stack S have passed by a forward end portion 313*a* of the first pressing member 313, they may tend to curl upwardly again. However, since the second sheet pressing member 413 is located beyond the first sheet pressing member 313, the leading ends of the documents are guided by the member 413 and the leading end portions press against the surface portion 107 of the separation roller 12 again. Thus, the forward end portions SA of the documents curling upwardly away from the surface portion 107 of the separation roller 12 are caused by the sheet pressing members 313 and 413 to press against the surface portion 107 at a plurality of points on the surface portion 107, with a result that the leading end portions SA are brought into contact with the surface portion 107 of the separation roller 12 in a greater area of contact than would otherwise be the case.

The upwardly curling leading end portions SA of the documents piled in the stack S are higher in the degree of curling before they pass by the forward end portion 313*a* of the first sheet pressing member 313 than after they have passed thereby. Thus, if the member 313 has a high degree of resilience, the leading end portions SA of the documents would be bent and prevented from entering the second auxiliary segment-shaped space 414. To avoid this risk, the resilience of the first sheet pressing member 313 is set at a relatively low level to enable the leading end portions SA to enter the first auxiliary wedge-shaped space 314 smoothly. The upwardly curling leading end portions SA have the degree of curling reduced to a great extent as they are guided by the bottom surface of the member 313 until they are released therefrom after moving along the forward end portion 313*a*. Thus, the leading end portions SA of the documents entering the second auxiliary wedge-shaped space 414 have sufficiently high rigidity to cause the second sheet pressing member 413 to flex upwardly even if the resilience of the member 413 is relatively high. This allows the leading end portions SA to enter readily between a leading end portion 413*a* of the second sheet pressing member 413 and the surface portion 107 of the separation roller 12.

In the embodiment shown in FIG. 11 and described hereinabove, the leading end portions of the documents are caused by a plurality of sheet pressing members to press against the surface portion of the outer peripheral surface of the separation roller, so that the leading end portions of the documents can be brought into contact with the surface portion in a greater area of contact than would otherwise be the case to ensure that the documents are positively fed in the sheet feeding direction. Since the leading end portions of the documents piled in a stack are pressed by the sheet pressing members at a plurality of spots, friction necessary for feeding the documents is produced even if the area of contact is not great. This would mean that the surface portion of the protruding portion of the outer periphery the separation roller need not be great in area and hence the separation roller need not be large in diameter. This permits an overall compact size to be obtained in an automatic sheet feeding device.

Still another embodiment of the invention will be described by referring to FIG. 12. This embodiment is characterized in that the pressing means for forcing the separation member 13 against the separation roller 12 and the regulating member for preventing the pressing means to move a distance greater than is necessary in a direction in which it moves away from the separation roller 12 are formed to have a compact size.

Figure 12:
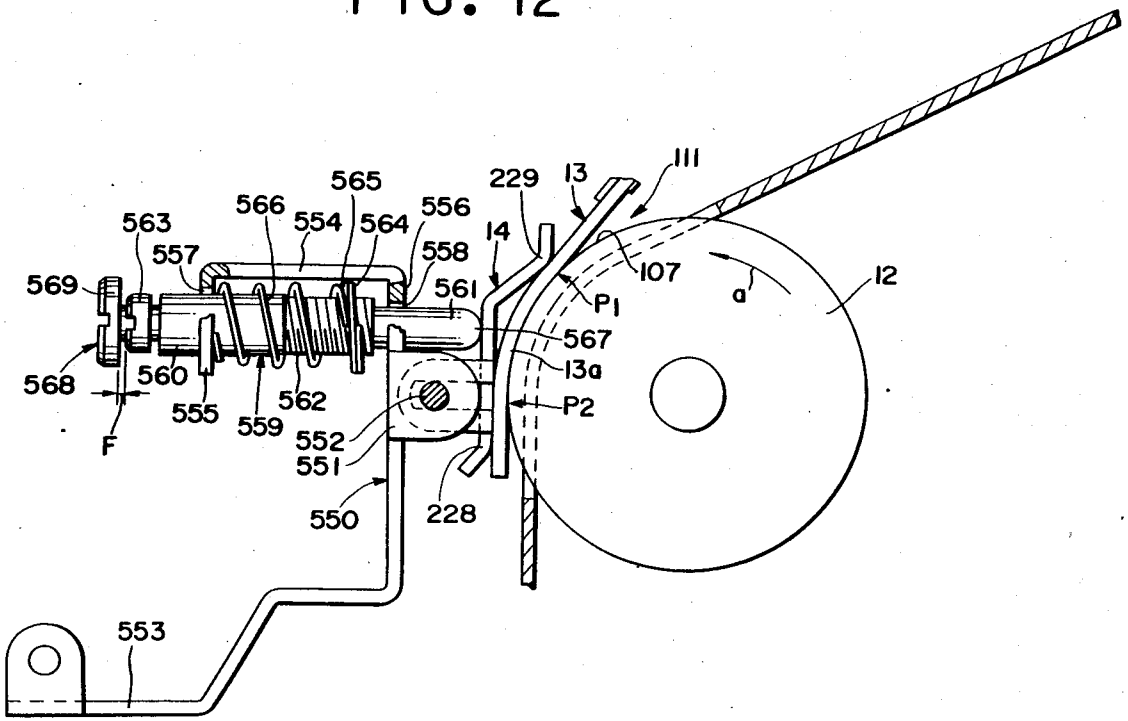
FIG. 12 is a sectional side view of the automatic sheet feeding device comprising still another embodiment of the invention.

Referring to FIG. 12, the pressing plate 14 is supported by a bar 552 which in turn is supported by a bent portion 551 of a bracket 550 for pivotal movement and movement toward and away from the separation roller 12 radially thereof. The bracket 550 which is secured at a base 553 to a stay, not shown, has a free end portion 554 which is bent in the form of a letter U having parallel legs 555 and 556 formed with a hole 557 of a large diameter and a hole 558 of a small diameter respectively. A pressing rod 559 includes a major diameter portion 560 loosely fitted in the large diameter hole 557, a minor diameter portion 561 loosely fitted in the small diameter hole 558, a threaded surface portion 562 formed on the major diameter portion 560, an adjusting head 563 formed substantially integrally with an end of the major diameter portion 560. A spring seat 564 is threadably fitted over the threaded surface portion 562 and comprises a torsion spring tending to tightly wind itself round the threaded surface portion 562 and having one end portion 565 of a length large enough to engage the free end portion 554 of the bracket 550. Wound round the pressing rod 559 is a pressing spring 566 connected at one end to the spring seat 564 and at an opposite end to the bent portion 555 to urge the pressing rod 559 to move toward the minor diameter portion 561. The minor diameter portion 561 has a forward end 567 maintained in pressing engagement with the back of the pressing plate 14. Thus, the resilience of the pressing spring 566 is transmitted via the pressing rod 559 and pressing plate 14 to the free end portion 13*a* of the separation member 13 to cause same to press against the surface portion 107 of the protruding portion of the outer periphery of the separation roller 12. The bracket 550, pressing rod 559, pressing spring 566 and pressing plate 14 constitute pressing means for the separation member 13.

Figure 13:
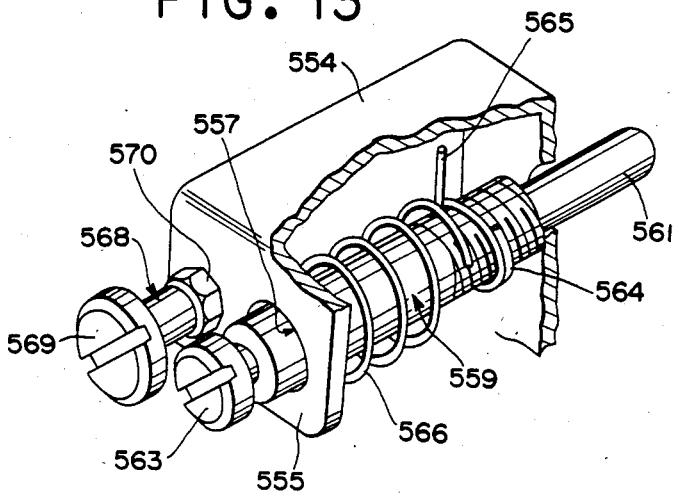
FIG. 13 is a perspective view of the automatic sheet feeding device shown in FIG. 12, with the essential portions thereof being fragmentarily broken away.

As shown in detail in FIG. 13, a regulating member 568 is threadably connected to the bent portion 555 of the bracket 550. The regulating member 568 is a spring having a head 569 which is positioned to cover a portion of the adjusting head 563. The regulating member 568 is located in the vicinity of the hole 557 formed in the bent portion 555 and a clearance F is defined between the head 569 of the regulating member 568 and the adjusting head 563 of the pressing rod 569.

The pressing force exerted by the pressing means on the separation member 13 is adjusted as follows. As the pressing rod 559 is rotated, the spring seat 564 axially moves and the spacing interval between the spring seat 564 and the bent portion 555 undergoes a change, so that the pressure at which the pressing spring 566 is set is altered. Since the one end portion 565 of the spring seat 564 engages the free end portion 554 of the bracket 660, the spring seat 564 moves axially without rotating. After the pressure of the pressing spring 566 is adjusted, the regulating member 568 is threadably moved to set the clearance F at a predetermined value. Then, the regulating member 568 is secured in position by a lock nut 570, as shown in FIG. 13.

The pressing plate 14 of this embodiment is also maintained in pressing contact with the free end portion 13*a* of the separation member 13 in the two portions 228 and 229 to cause same to press against the surface portion 107 of the protruding portion of the outer periphery of the separation roller 12. Thus, the pressing points $P_1$ and $P_2$ important for separation are located between the separation member 13 and separation roller 12.

The pressing means and regulating member of the embodiment shown in FIGS. 12 and 13 can achieve the same effects as the pressing means and regulating member of the embodiment shown in FIG. 10. The additional advantage offered by the embodiment shown in FIGS. 12 and 13 is that the pressing means and regulating member have a compact size.

A further embodiment of the invention will be described by referring to FIG. 15. This embodiment is of the simplest construction of all the embodiments and comprises only a sheet pressing member 113 in addition to the separation member 13. The sheet pressing member 113 is secured to the bracket 117 and its forward end 113*a* is positioned against the separation roller 12 in the same manner as described by referring to the corresponding parts of the embodiment shown in FIG. 3.

Figure 15:
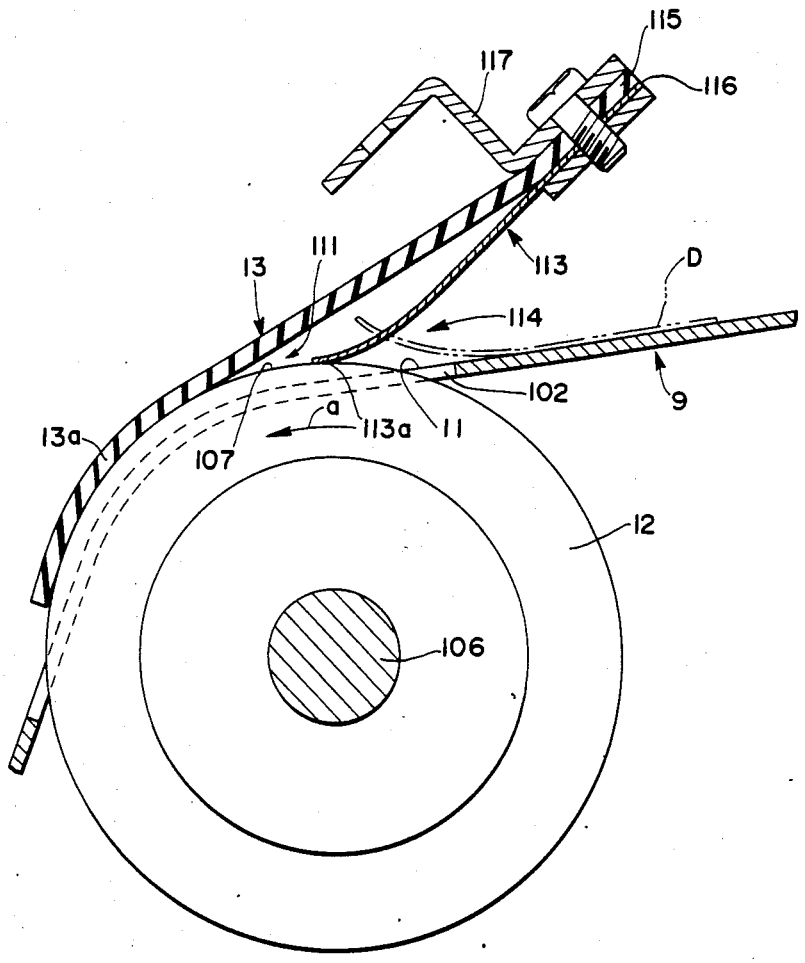
FIG. 15 is a sectional side view of the automatic sheet feeding device comprising a further embodiment of the invention.

In the embodiment of the simple construction shown in FIG. 15, a document D is forced by the sheet pressing member 113 against the separation roller 12 with such a force as to create between the document D and separation roller 12 sufficiently high friction to enable the document D to be fed by the separation roller 12 in the sheet feeding direction a. Even if the document D has an upwardly curling leading end portion, the leading end portion can be straightened by the sheet pressing member 113, thereby enabling the document D to be positively fed in the sheet feeding direction a. The effects achieved in this embodiment are similar to those achieved in the embodiment shown in FIGS. 6 and 7.

Figure 16:
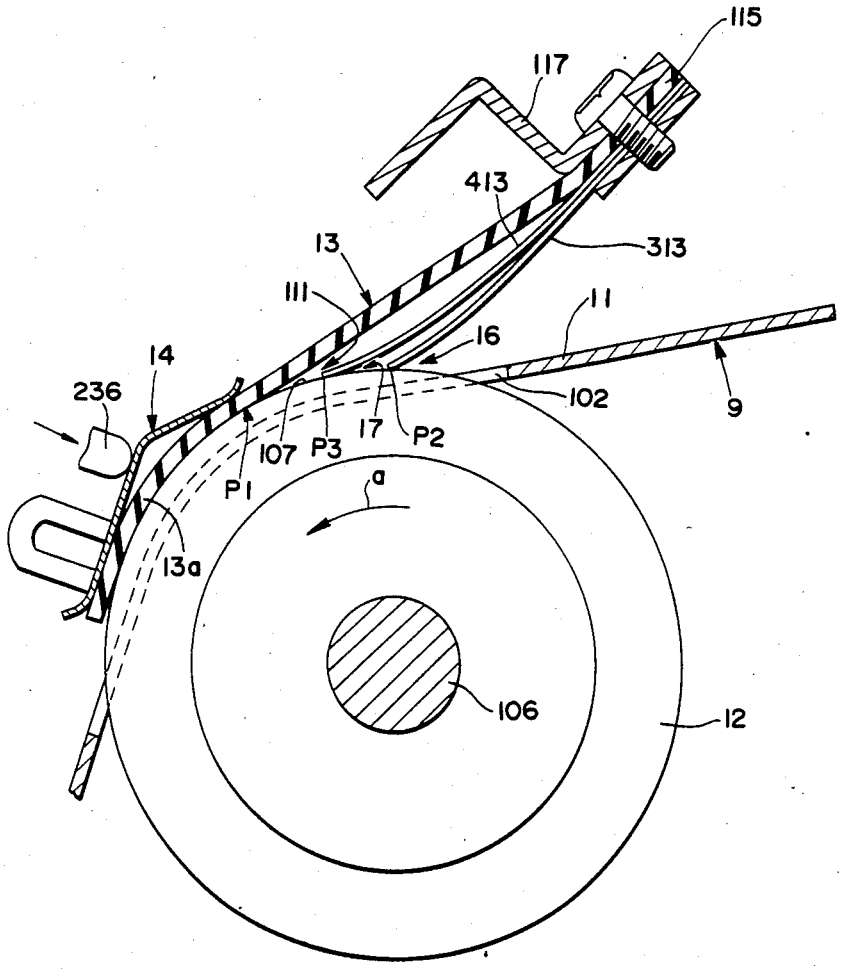
FIG. 16 is a sectional side view of the automatic sheet feeding device comprising a modification of the embodiment shown in FIG. 15.

FIG. 16 shows a modification of the embodiment shown in FIG. 15, in which two sheet pressing members 313 and 413 are provided in place of the single sheet pressing member 113 shown in FIG. 15. Pressing means including the pressing plate 14 and the pressure applying portion 236 of the pressing arm may be positioned against the free end portion 13*a* of the separation member 13.

In each of the embodiments shown and described hereinabove, the invention has been described as being incorporated in a facsimile transmitter for separating and feeding documents in the form of sheets. However, the invention is not limited to the separation and feeding of documents in a facsimile transmitter and can have application in apparatus of any type as desired where separation and feeding of sheets take place, such as recording sheets of a facsimile receiver, documents and copy sheets of a copying apparatus, printing sheets of a printing press, and packing sheets of a packaging machine.

What is claimed is:

1. An automatic sheet feeding device comprising:

(a) a sheet tray for supporting a stack of sheets thereon;

(b) a separation roller having a portion of an outer periphery thereof protruding from a sheet support surface of a forward end portion of said sheet tray on which the stack of sheets is supported, said separation roller rotating in a sheet feeding direction;

(c) a separation member including a base which is secured in place above the sheet support surface and a free end portion maintained in surface-to-surface contact at a first position with a surface of the protruding portion of the outer periphery of said separation roller downstream from the base in the sheet feeding direction, said separation member cooperating with said separation roller to define therebetween a wedge-shaped space;

(d) at least one sheet pressing member cooperating with said separation roller to define therebetween an auxiliary wedge-shaped space, said at least one sheet pressing member being formed as a flexible sheet having a free end resiliently pressing a leading end of a plurality of sheets against the outer periphery of said separation roller at a second position which is located upstream of the first position in which said free end portion of said separation member is in surface-to-surface contact with said separation roller; and (e) a separation member pressing means maintained in pressing contact with a back surface of said free end portion of said separation member at a plurality of pressing points spaced apart upstream and downstream along said first position and movable in a direction toward and away from said separation roller, said separation member pressing means being operative to force said free end portion of said separation member against the outer periphery of said separation roller when it moves towards said separation roller.

2. An automatic sheet feeding device as claimed in claim 1 and further comprising a regulating member for preventing said at least one sheet pressing member from moving a distance greater than is nesscessary in a direction in which it moves away from said separation roller.

3. An automatic sheet feeding device according to claim 1 wherein said separation member pressing means includes:

(a) a pressing plate having forward and rearward portions pressing said separation member at said upstream and downstream pressing points and (b) a pressing rod which engages said pressing plate at a location between said forward and rearward portions such that said pressing plate pivots about said pressing rod, lifting one of said forward or rearward portions from said separation roller and pressing the other one of said forward or rearward portions toward said separation roller.

4. An automatic sheet feeding device comprising:

(a) a sheet tray for supporting a stack of sheets thereon;

(b) a separation roller having a portion of an outer periphery thereof protruding from a sheet support surface of a foraward end portion of said sheet tray on which the stack of sheets is supported, said separation roller rotating in a sheet feeding direction;

(c) a separation member including a base which is secured in place above the sheet support surface and a free end portion maintained in surface-to-surface contact at a first positon with a surface of the protruding portion of the outer periphery of said separation roller downstream from the base in the sheet feeding direction, said separation member cooperating with said separation roller to define therebetween a wedge-shaped space;

(d) two sheet pressing members cooperating with said separation roller to define therebetween an auxiliary wedge-shaped space, said two sheet pressing members being formed as flexible sheets each one of which has a free end resiliently pressing a leading end of a plurality of sheets against the periphery of said separation roller at a second position which is located upstream of the first position in which said free end portion of said separation member is in surface-to-surface contact with said separation roller, said two sheet pressing members having free ends spaced apart in the downstream direction, the one of said two pressing members located on the downstream side with respect to the sheet feeding direction being sized, shaped and positioned to force sheets against the outer periphery of said separation roller with a force higher than the one of said two sheet pressing members located on the upstream side; and (e) a separation member pressing means maintained in pressing contact with a back surface of said free end portion of said separation member at a plurality of pressing points spaced apart upstream and downstream along said first position and movable in directions toward and away from said separation roller, said separation member pressing means being operative to force said free end portion of said separation member against the outer periphery of said separation roller when it moves toward said separation roller.

* * * * *